US006161510A

United States Patent [19]

Ishikawa et al.

[11] Patent Number: 6,161,510

[45] Date of Patent: Dec. 19, 2000

[54] SEPARATE LUBRICATING DEVICE FOR AN INTERNAL COMBUSTION ENGINE

[75] Inventors: Takeshi Ishikawa; Tadashige Kondo, both of Tokyo, Japan

[73] Assignee: Kioritz Corporation, Tokyo, Japan

[21] Appl. No.: 09/350,260

[22] Filed: Jul. 8, 1999

[30] Foreign Application Priority Data

Jul. 10, 1998 [JP] Japan ..... 10-195315

[51] Int. Cl.[7] ..... F01M 1/02; F01M 11/00; F02B 63/02

[52] U.S. Cl. ..... 123/73 AD

[58] Field of Search ..... 123/73 AD, 196 R, 123/196 A, 196 CP, 572

[56] References Cited

U.S. PATENT DOCUMENTS

| | | | |
|---|---|---|---|
| 4,930,462 | 6/1990 | Kamata . | |
| 5,020,484 | 6/1991 | Ishidawa et al. | 123/73 AD |
| 5,103,777 | 4/1992 | Daikoku | 123/73 AD |
| 5,363,814 | 11/1994 | Daikoku | 123/73 AD |
| 5,829,401 | 11/1998 | Masuda | 123/73 AD |

FOREIGN PATENT DOCUMENTS

| | | |
|---|---|---|
| 1113510 | 5/1989 | Japan . |
| 491250 | 8/1992 | Japan . |
| 213111 | 1/1998 | Japan . |
| 1037730 | 2/1998 | Japan . |
| 10131726 | 5/1998 | Japan . |

*Primary Examiner*—Marguerite McMahon
*Attorney, Agent, or Firm*—Baker Botts L.L.P.

[57] ABSTRACT

A separate lubricating device for an internal combustion engine includes a lubricating oil injection nozzle for injecting a lubricating oil into a passage of an air intake system and an electric deliverer for delivering a lubricating oil from an oil tank to the lubricating oil injection nozzle. The electric deliverer is positioned remotely from the lubricating oil injection nozzle. The electric deliverer may, to special advantage, be housed inside the oil tank.

7 Claims, 6 Drawing Sheets

STOP SWITCH
IGNITION POWER SOURCE CIRCUIT
IGNITION CONTROL CIRCUIT
INJECTION MODE CONTROL MEANS
INJECTION QUANTITY CONTROL MEANS
INJECTION CONTROL MEANS
INJECTION POWER SOURCE CIRCUIT
THROTTLE LEVER
AIR-INTAKE CONTROL VALVE
LOAD-DETECTING MEANS
9
36a
73
74
75
76
77
47
48
48a
63
67
36b
39c
39d
37d
37b
37c
37a
35a
35
38a
38
37
39b
39a
39
36
50
51
52
53

SEPARATE LUBRICATING DEVICE FOR AN INTERNAL COMBUSTION ENGINE

BACKGROUND OF THE INVENTION

The present invention relates to a separate lubricating device for an internal combustion engine and, in particular, to a separate lubricating device which is designed to deliver a lubricating oil by means of an electronic control to an internal combustion engine, such as a relatively small two-stroke internal combustion engine that is suited for use in a portable working machine, for example, a chain saw, a bush cutter, or the like.

As the oil supply system for a two-stroke internal combustion engine (hereinafter, referred to simply as an internal combustion engine), there have been previously known two different systems, i.e.: a mixture method lubrication system wherein a lubricating oil is mixed in advance with fuel before it is fed to the intake of the engine; and a separate lubricating system wherein a lubricating oil is supplied mechanically by making exclusive use of a lubricating oil pump (see, for example, Japanese Patent Unexamined Publication H1-113510; and Japanese Utility Model Unexamined Publication H2-13111).

However, since the aforementioned mixture method lubrication system is designed to feed a lubricating oil at a predetermined mixing ratio (usually adjusted to conform with the quantity required for a high revolution speed of engine to be employed), it is difficult to adjust the quantity of lubricating oil to an optimum degree in conformity with the operating condition of engine, thus raising the problems of generating smoke or offensive odor, particularly when the engine is running at a low speed or is idling.

On the other hand, with the conventional separate lubricating system, the lubricating oil pump is driven by a motive power derived from a crankshaft of an internal combustion engine, thereby to enable an optimum quantity of lubricating oil to be fed from the discharge port of the lubricating oil pump to the internal combustion engine in conformity with the revolution speed of the engine. However, there is a problem in that a fine control in supplying a lubricating oil cannot be achieved by only controlling the revolution speed of the pump.

Furthermore, with the system for mechanically supplying a lubricating oil, since the lubricating oil pump is driven by making use of a driving force of engine, the pumping efficiency of the lubricating oil pump is caused to decrease as the revolution speed of the engine becomes higher, thus raising a problem in that it becomes impossible to supply a sufficient quantity of lubricating oil which is necessary for a high revolution speed of engine.

With a view to overcoming the aforementioned problems, the owner of the present invention has already proposed a separate lubricating device for a two-stroke internal combustion engine, which is capable of controlling the supplying quantity or supplying time of a lubricating oil based on the operating condition of engine, thereby always enabling an optimum quantity of lubricating oil to be fed to the engine with fine controlling (see Japanese Patent Unexamined Publication H10-131726).

The separate lubricating device for an internal combustion engine that has been proposed previously by the owner of the present invention is provided at a passage of an air intake system with an injector having a heating element for heating the lubricating oil, thereby enabling the lubricating oil to be injected from the injector into the passage of the air intake system, and with a lubricating control device for controlling the injection timing and the quantity of the lubricating oil to be injected from the injector into the engine.

The separate lubricating device for an internal combustion engine thus proposed has been found, however, to be less than optimal in that the self-suctioning thereof, the number of pipes required, and the heat and vibration of the internal combustion engine are not fully taken into consideration. Namely, since the previously proposed separate lubricating device has an injector for delivering and injecting a lubricating oil in response to an electric load that is disposed at a passage of the air intake system, there is a possibility that the heat of the internal combustion engine may be transmitted to the injector. If the injector is subjected to an influence of heat from the internal combustion engine, the quantity of lubricating oil to be delivered and injected from the injector may be varied, even if the same magnitude of electric load is transmitted to the injector, thus introducing an error into the control of the supply of lubricating oil.

Also, when the vibration of the internal combustion engine is transmitted to the injector, the injector may be caused to vibrate, thereby adversely influencing the delivering and injecting of lubricating oil, thus diminishing the accuracy of the control of the supply of lubricating oil, and at the same time, the durability of the injector may be adversely affected.

SUMMARY OF THE INVENTION

The present invention has been made under the aforementioned circumstances, and therefore an object of the present invention is to provide a separate lubricating device for an internal combustion engine, which is capable of being stably operated with excellent self-suctioning and high precision without being influenced by the heat and vibration of the internal combustion engine, capable of reducing the number of pipes and the manufacturing cost thereof, and capable of minimizing any failure thereof, thus ensuring an high degree of durability.

With a view to attaining the aforementioned object, the present invention provides a separate lubricating device for a two-stroke internal combustion engine having an air intake system. The separate lubricating device comprises a lubricating oil injection nozzle for injecting a lubricating oil into a passage of the engine air intake system and an electric deliverer for delivering a lubricating oil drawn from an oil tank to the lubricating oil injection nozzle, the electric deliverer being positioned remotely from the lubricating oil injection nozzle.

With the separate lubricating device constructed as described above, the electric deliverer for lubricating oil can be electrically controlled by an output signal from a controlling device that controls the delivery of lubricating oil with high precision without being influenced by the heat and vibration of the internal combustion engine, and at the same time, the durability of the electric deliverer for the lubricating oil can be enhanced.

In a preferred embodiment of the separate lubricating device for an internal combustion engine according to the present invention, the electric deliverer is housed inside the oil tank. When the electric deliverer is housed inside the oil tank, the electric deliverer can be cooled by the lubricating oil stored inside the oil tank, and the electric deliverer is able to operate under a constant temperature condition, thus making it possible to control the feeding of lubricating oil with high precision.

In another preferred embodiment of the separate lubricating device according to the present invention, the electric deliverer is provided with a heating element for heating the lubricating oil, with a strainer for the lubricating oil, and with a flow sensor.

It is possible, with the above-described construction of the electric deliverer, to miniaturize the entire body of the electric deliverer, thus facilitating the mounting of the electric deliverer inside of, on the side of, of close to the oil tank, and to detect the flow rate of a lubricating oil being delivered from the electric deliverer by making use of the flow sensor.

DESCRIPTION OF THE DRAWINGS

For a more complete understanding of the present invention and the advantages thereof, reference may be made to the following written description of exemplary embodiments, taken in conjunction with the accompanying drawings.

DESCRIPTION OF THE EMBODIMENTS

The present invention will be further explained with reference to the accompanying drawings, which show exemplary embodiments of a separate lubricating device for an internal combustion engine according to the present invention.

Figure 1:
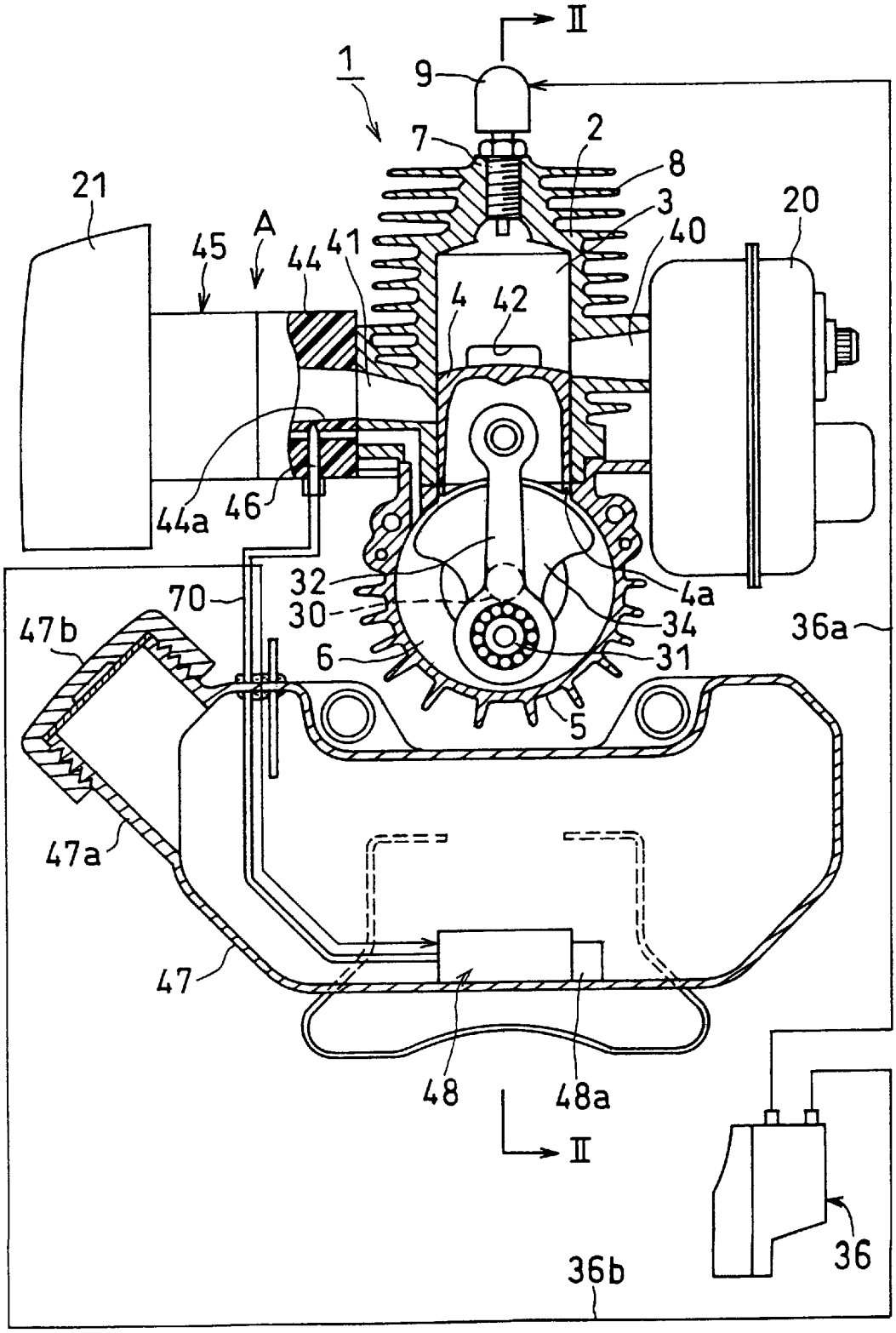
FIG. 1 is a side cross-sectional view of a two-stroke internal combustion engine that is equipped with one embodiment of a separate lubricating device according to the present invention.
Figure 2:
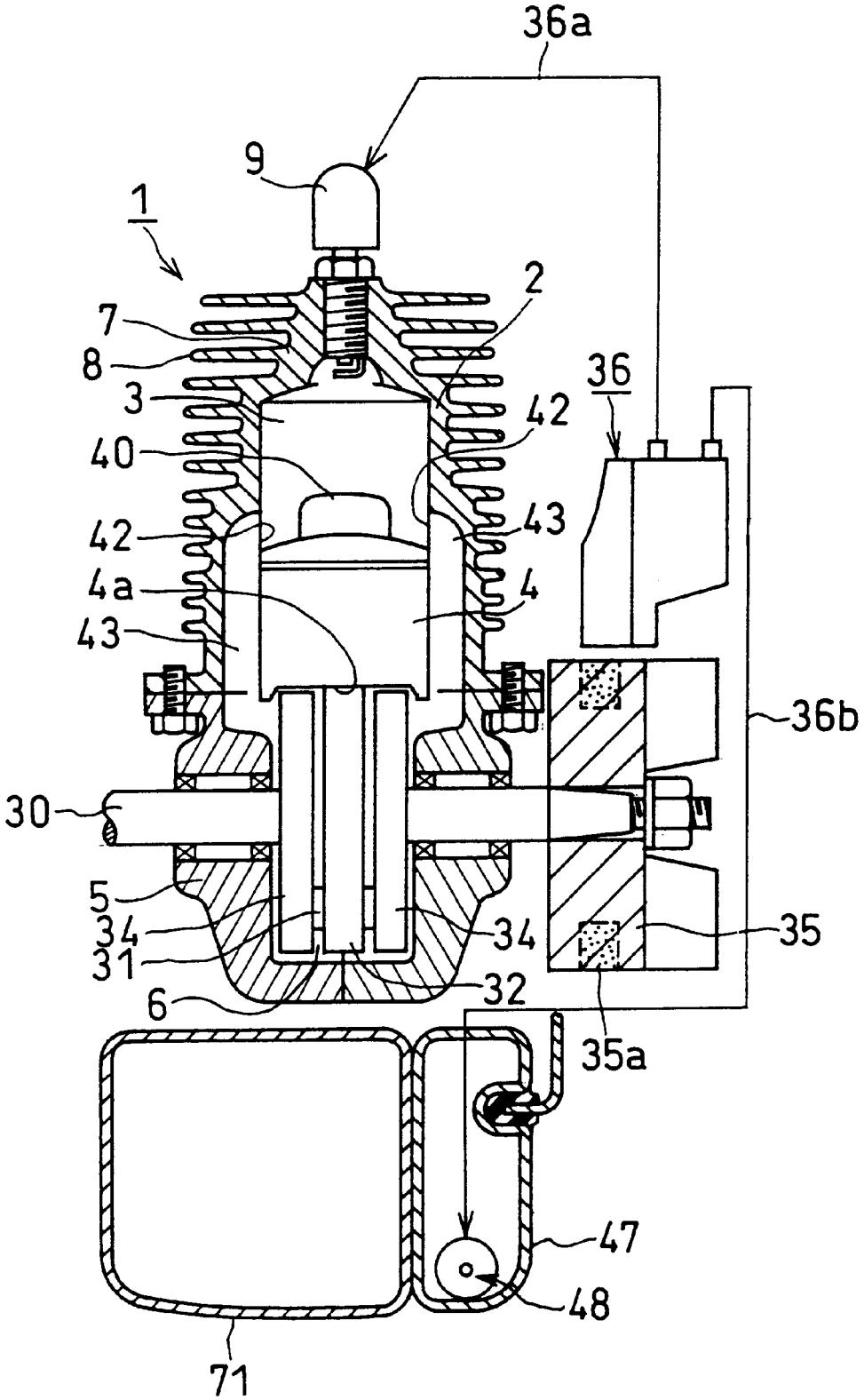
FIG. 2 is a cross-sectional view of the internal combustion engine shown in FIG. 1 taken along the line II—II of FIG. 1.

FIG. 1 is a longitudinal cross-sectional view of a piston valve type small air-cooled two-stroke internal combustion engine (hereinafter, also referred to simply as an internal combustion engine) 1 to which a separate lubricating device according to a first embodiment is applied, while FIG. 2 is a cross-sectional view taken along the line II—II of FIG. 1. Referring to FIGS. 1 and 2, the internal combustion engine 1 is an air-cooled two-stroke gasoline engine of so-called Schnürle type crankcase pre-compression system. Specifically, the internal combustion engine 1 comprises a cylinder block 2 having a cylinder chamber 3 into which a piston 4 is slidably inserted so as to enable the piston 4 to be moved up and down, a crankcase 5 of split type provided therein with a crank chamber 6 and connected to the bottom portion of the cylinder block 2, and a cylinder head 7 formed integrally with the upper portion of the cylinder block 2. A large number of air-cooling fins 8 are formed on the outer peripheral wall of the internal combustion engine 1, and an ignition plug 9 is mounted at a suitable position in the cylinder head 7.

A fuel tank 71 and an oil tank (a lubricating oil tank) 47 are located below the crankcase 5. The oil tank 47 receives an electric deliverer 48 for lubricating oil and has on one side thereof an inlet port 47*a* for introducing lubricating oil into the oil tank 47 as well as a cap 47*b* for closing the inlet port 47*a*.

The crankcase 5 is of a closed, short cylindrical configuration. A crankshaft 30 is supported at generally the central regions of the right and left ends of the crankcase 5. The crankshaft 30 is provided with a crank pin 31 to which the piston 4 is connected through a connecting rod 32. A pair of sector-shaped crank webs are respectively secured to the left and right ends of the crank pin 31 with the connecting rod 32 being interposed between the pair of sector-shaped crank webs. Therefore, the pair of sector-shaped crank webs rotate with the crankshaft 30.

One end of the crankshaft 30 is fixed to an air cooling fan-attached rotor 35, in which magnets 35*a* are embedded. An internal combustion engine-controlling device 36 (see FIG. 4, explained in detail hereinafter) in which an ignition control device 37 and a lubricating control device 39 are integrally incorporated is disposed to face the outer peripheral surface of the rotor 35. The output power from the internal combustion engine-controlling device 36 is fed via a first conductor 36*a* to the ignition plug 9 as well as via a second conductor 36*b* to the electric deliverer 48.

The cylinder block 2 is provided with an exhaust port 40 that opens at a portion of the internal wall surface of the cylinder chamber 3, which faces to orthogonally intersect with the axis of the crankshaft 30. The cylinder block 2 has an intake port 41 that opens at a portion of the internal wall surface of the cylinder chamber 3, which faces the portion of the internal wall surface of the cylinder chamber 3 where the exhaust port 40 is located (i.e. a position which is offset by an angle of 180 degrees), the intake port 41 being, however, disposed at a lower level than that of the exhaust port 40. Additionally, a pair of scavenging ports 42 are respectively opened at the portions of the internal wall surface of the cylinder chamber 3, which are offset from the exhaust port 40 and also from the intake port 41 by an angle of 90 degrees (the right and left sides of FIG. 2) so that the openings of the pair of scavenging ports 42 face each other. The pair of scavenging ports 42 are formed respectively at the upper ends of the scavenging passages 43, each extending to a lower portion of the cylinder block 2 and communicating with the crank chamber 6.

An air intake system "A" associated with the intake port 41 includes a heat insulator 44 and a carburetor 45. Further, an air cleaner 21 is mounted on the air inflow side or upstream side of the carburetor 45.

To the heat insulator 44 is attached a lubricating oil injection nozzle 46, which is directed to a passage 44*a* formed in the heat insulator 44. The electric deliverer 48 disposed inside the oil tank 47 is mounted integrally with a lubricating oil strainer 48*a*, so that lubricating oil passes through the strainer 48*a* and is delivered to the injection nozzle 46 via a pipe 70. The lubricating oil is injected from the injection nozzle 46 into the passage 44*a*, the injection being controlled by the lubrication controlling device 39 of the control device 36 of the engine 1, as explained hereinafter.

Figure 3:
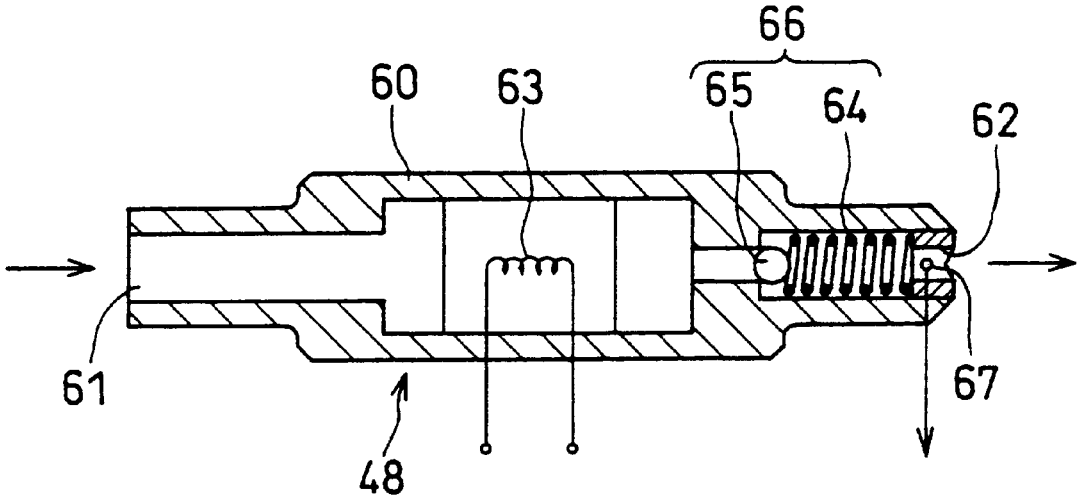
FIG. 3 is a longitudinal cross-sectional view schematically illustrating one embodiment of the electric deliverer for lubricating oil employed in the separate lubricating device shown in FIG. 1.

FIG. 3 shows one example in structure of the electric deliverer 48 for lubricating oil. The electric deliverer 48 comprises a main body 60 having an oil inlet port 61 at one end thereof and an oil outlet port 62 at the other end thereof. A heating element 63 for controlling the quantity of oil delivered by the electric deliverer 48 is disposed in the interior of the main body 60. A check valve 66 composed of a coil spring 64 and a ball 65 is disposed inside the oil outlet port 62. The oil outlet port 62 also has a flow sensor 67 for detecting the flow of lubricating oil passing through the oil outlet port 62.

Figure 4:
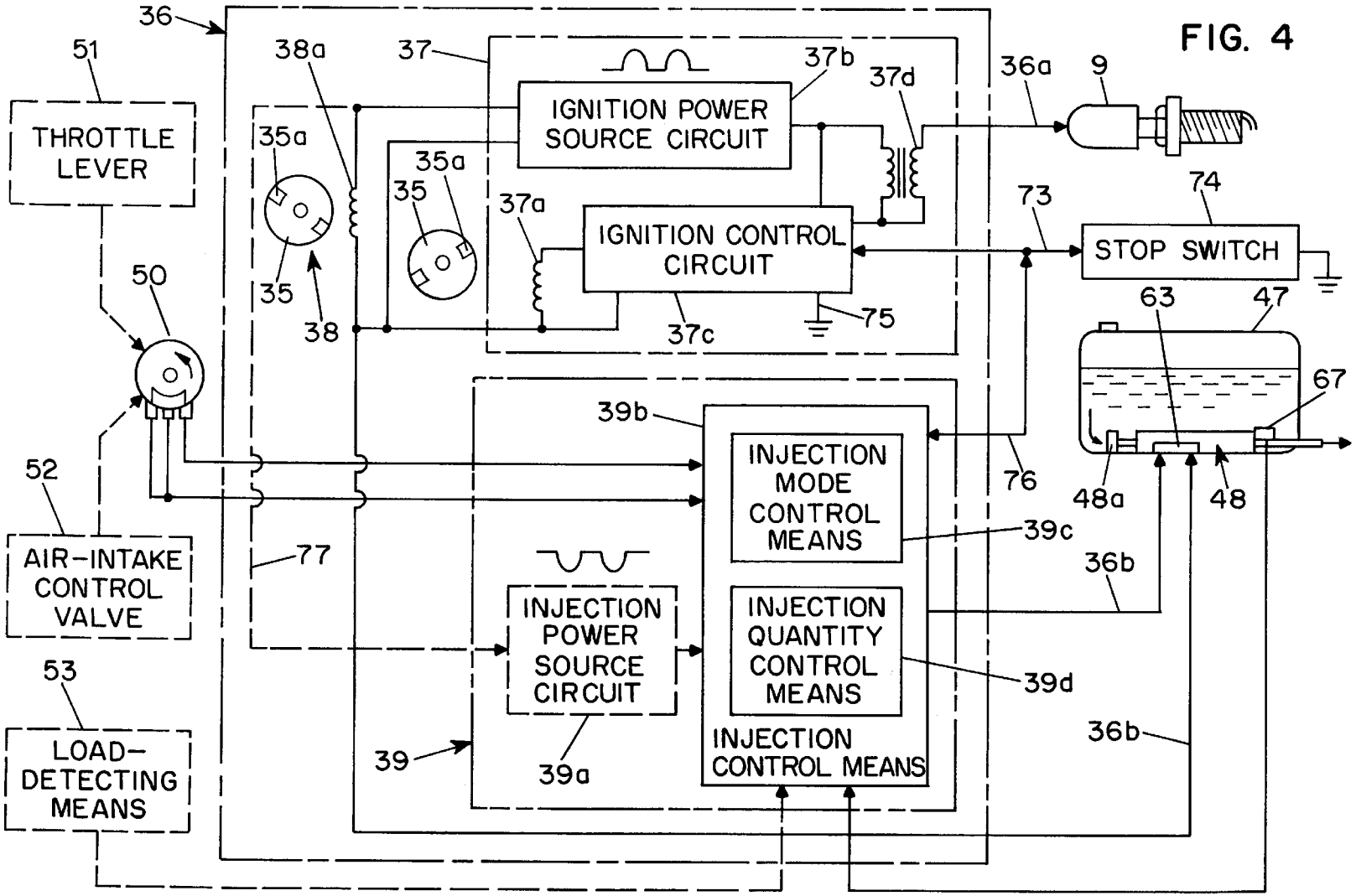
FIG. 4 is a diagram illustrating the function and wiring of the separate lubricating device shown in FIG. 1.

FIG. 4 is a wiring diagram of the internal structure of the control device 36 according to the embodiment and indicates the relationship between the ignition plug 9 and the electric deliverer 48, which are actuated by the control device 36.

Specifically, the control device 36 is constituted generally by an integrated body comprising the ignition control device 37 of an electronic system, such as a CDI system or a TCI system, an AC power generation means 38, and the lubricating control device 39. The AC power generation means 38 is designed to generate an electric power through the rotation of the cooling fan-attached rotor 35, thereby to supply electric power to the ignition control device 37 as well as to the electric deliverer 48, thus energizing the ignition plug 9 and the electric deliverer 48.

The ignition control device 37 is of a conventional design, comprising a pick-up coil 37*a* for controlling the ignition timing, an ignition power source circuit 37*b* for performing a half-wave rectification of AC power fed from the AC power generation means 38, an ignition control circuit 37*c*, an ignition coil 37*d*, etc.

The lubricating control device 39 comprises an injection power source circuit 39*a* and the lubricating oil control means (circuit) 39*b* for controlling the injection timing and injection quantity of lubricating oil. The lubricating oil control means 39*b* is provided with an injection mode control means 39*c* for controlling the injection timing of the delivery of lubricating oil on the basis of a source power and an engine rotation signal fed from the conductor 73 of the engine stop switch 74 connected with the ignition control circuit 37*c*, and an injection quantity-controlling means 39*d* for controlling the injection quantity of lubricating oil.

The ignition control device 37 is connected, via a high voltage cable 36*a* constituting the aforementioned first conductor, with the ignition plug 9, while the lubricating control device 39 is connected via the aforementioned second conductor 36*b* with the electric deliverer 48 for the lubricating oil.

Although the ignition control device 37 is designed to perform the ignition thereof by making use of an AC electromotive force generated by the AC power generation means 38, the actual electromotive force used for the ignition of the internal combustion engine 1 is a half-wave voltage of either the plus or the minus side of the generated voltage in the embodiment; the other side of the half-wave voltage is not utilized for ignition. According to the embodiment, the half-wave voltage of the side which is not utilized for ignition is utilized to actuate the injecting lubricating oil control means 39*b* and the electric deliverer 48, thereby making it possible to reduce the load of the conductor 73 of the stop switch 74.

More specifically, the AC power generation means 38 is designed to generate an AC electromotive power through the rotation of the cooling fan-attached rotor 35, thereby enabling an ignition to be effected at the moment when the voltage changes from the plus side (or minus side) to the minus side (or plus side) on the basis of the voltage of the plus side (or minus side). In this case, the electric deliverer 48 for lubricating oil is actuated as follows. First of all, in order to utilize an AC electromotive power of the minus side (or plus side) which is opposite to that utilized for the aforementioned ignition, the aforementioned AC electromotive power is taken up from the ignition control device 37 and fed to the lubricating control device 39, and then the heating element 63 of the electric deliverer 48 is instantaneously heated by taking advantage of an electric voltage of the minus side (or plus side) which is opposite to that utilized in the ignition control device 37, thereby causing a lubricating oil to be delivered from the oil outlet port 62.

Meanwhile, a source power derived through the stop switch 73 from the ignition control circuit 37*c* or an AC power generated at the AC power generation means 38 is fed via a conductor 77 to the lubricating control device 39, and then subjected to the half-wave rectification at the injection power source circuit 39*a*, the resultant source power thus obtained being subsequently fed to the lubricating oil control means 39*b*. The lubricating oil control means 39*b* is designed to output an electric power, based on an output (engine revolution) signal from the ignition control circuit 37*c* that has been derived from the conductor 73 of the stop switch 74, to the heating element 63 through the second conductor 36*b*, thereby instantaneously energizing the heating element 63 at a high voltage and raising the temperature of the lubricating oil in the electric deliverer 48 to a high temperature such as to deliver the heated lubricating oil to the oil outlet port 62 through the check valve 66.

When the operation of the internal combustion engine 1 is to be stopped, the stop switch 74 is manipulated so as to switch the ignition control circuit 37*c* to the ground 75 side, thereby turning the ignition control circuit 37*c* to OFF, stopping the ignition, and hence the supply of the source power and the engine revolution signal to the lubricating oil control means 39*b* are automatically intercepted, thus stopping the operation of the electric deliverer 48 as well as the discharge of the lubricating oil from the lubricating injection nozzle 46.

It is generally required to control the discharging quantity of lubricating oil in such a manner that the quantity of lubricating oil is increased at the occasion of a high revolution speed of the engine, while the quantity of lubricating oil is decreased at the occasion of low revolution speed of the engine. Therefore, the information on the revolution speed (including the stoppage of engine) of the internal combustion engine 1 is indispensable for controlling the discharging quantity of lubricating oil. According to the embodiment, the information on the revolution speed is made available through the detection of ON/OFF of the ignition control circuit 37*c* as information on the revolution of the engine 1 without requiring any special sensor. Further, even if the engine 1 is required to be stopped due to the exhaustion of oil, the operation of the engine 1 as well as the supply of oil can be simultaneously stopped by simply turning the stop switch 74 to OFF.

Further, the injection mode control means 39*c* shown in FIG. 4 is designed to transform the aforementioned DC power into a sequential rectangular pulse wave by means of a pulse generator, etc. and at the same time, to control the output interval of the pulse wave, thereby to control the injection interval (injection mode).

As for the specific type of control of the injection mode control means 39*c*, it may be a continuous injection mode wherein a lubricating oil is delivered from the electric deliverer 48 thereby to inject the lubricating oil from the injection nozzle 46 at every wave of the aforementioned pulse wave, or it may be an intermittent injection mode wherein the output of the pulse wave pauses on every other wave, thereby causing the lubricating oil to be injected once per every two waves of the pulse wave. Alternatively, the specific type of control of the injection mode control means 39*c* may be a "thinned-out" injection mode wherein the output of the pulse wave pauses for two waves out of every three waves, thereby causing the lubricating oil to be injected once per every three waves of the pulse wave.

The injection quantity-controlling means 39*d* is designed to control the delivering quantity of lubricating oil in each delivering quantity of lubricating oil from the electric deliverer 48 (the injecting quantity of the injection nozzle 46). Namely, the heating degree of the heating element 63 is controlled by the injection quantity-controlling means 39*d* so as to adjust the quantity of lubricating oil delivered from the electric deliverer 48. In other words, the entire quantity of lubricating oil delivered from the electric deliverer 48 is altered based on the output signal of the load-detecting means 53, which is designed to detect the variation in the load of the engine 1 such as the revolution speed of the internal combustion engine 1 or the seat temperature of the ignition plug 9.

The quantity of lubricating oil delivered from the electric deliverer 48 may be adjusted also on the basis of the detection of the flow rate of lubricating oil by the flow sensor 67 which is mounted on the electric deliverer 48, and at the same time, it is also possible, by making use of the flow sensor 67, to confirm whether or not the lubricating oil is actually delivered.

Next, the controlling operation of the separate lubricating device of the internal combustion engine constructed according to the embodiment will be explained.

The internal combustion engine 1 according to the embodiment which is shown in FIGS. 1 and 2 is of so-called piston valve system, wherein neither an intake valve nor an exhaust valve are provided, but simply the piston 4 is slidably moved up and down, thereby allowing the intake port 41 or the exhaust port 40 to be opened to or communicated with the crank chamber 6 or the cylinder chamber 3 so as to perform the intake or exhaust of the engine, i.e. the same functions as those of the aforementioned intake valve and exhaust valve.

When the internal combustion engine 1 is operating and the piston 4 is moving up and down, outside air is allowed to enter from the air cleaner 21 and to move via the carburetor 45 into the intake port 41 in the form of an air-fuel mixture. On the other hand, the heating element 63 of the electric deliverer 48 is heated by the power from the AC-generating means 38, thereby causing the heating element 63 to be instantaneously heated at a high voltage. Due to the heating of the heating element 63, the lubricating oil inside the electric deliverer 48 is instantaneously heated, thereby causing a change in phase of the lubricating oil, resulting in the generation of air bubbles.

As the air bubbles grow, the inner pressure inside the electric deliverer 48 increases, thereby causing the lubricating oil in the electric deliverer 48 to be instantaneously delivered from the oil outlet port 62. The lubricating oil thus delivered from the oil outlet port 62 is then guided into the injection nozzle 46 through the pipe 70 so as to be injected into the passage 44*a* of the heat insulator 44 from the tip end of the injection nozzle 46. Namely, the lubricating oil is instantaneously injected synchronously with the heating of the heating element 63 and mixed into the air-fuel mixture, the resultant mixture being fed to the interior of the internal combustion engine 1. Since the electric deliverer 48 is disposed at the bottom of the oil tank 47, when the lubricating oil is delivered in this manner from the oil outlet port 62 of the electric deliverer 48, the lubricating oil in the oil tank 47 is automatically fed to the oil inlet port 61 of the electric deliverer 48 due to its own weight, thus making the electric deliverer 48 ready for the next delivery.

When the piston 4 descends down to the vicinity of the bottom dead center, the exhaust port 40 is opened to the interior of the cylinder chamber 3, thereby allowing the burned exhaust gas in the cylinder chamber 3 to be discharged from the engine 1 to the exhaust muffler 20. Thereafter, the scavenging ports 42 are allowed to open to the cylinder chamber 3. When the scavenging ports 42 are opened in this manner, the air-fuel mixture pre-compressed in the crank chamber 6 is allowed to enter via the scavenging passageways 43 into the cylinder chamber 3 thereby to purge out the residual burned exhaust gas remaining in the cylinder chamber 3, thus scavenging the cylinder chamber 3.

While the scavenging operation is being effected, the piston 4 is moving upwardly again, and the scavenging ports 42 are closed again.

In the upward movement of the piston 4, the scavenging ports 42 are closed at first, and then, the exhaust port 40 is also closed, thereby initiating the compression stroke. When the piston 4 reaches the vicinity of the upper dead center, a high voltage power from the ignition control device 37 of the control device 36 is fed via the high voltage cable 36*a* to the ignition plug 9. As a result, a spark discharge is generated, thereby causing the ignition of the compressed air-fuel mixture to occur in the cylinder chamber 3.

Meanwhile, when the piston 4 moves during a compression stroke, the pressure inside the crank chamber 6 is caused to decrease as the piston 4 moves upwardly, so that when the skirt portion 4*a* of the ascending piston 4 passes over the lower edge of the intake port 41, thereby to allow the intake port 41 to open to the crank chamber 6, outside air is immediately inducted and mixed with fuel in the carburetor 45, thus forming an air-fuel mixture, which is then inducted into the crank chamber 6. When that occurs, the lubricating oil is also mixed into the air-fuel mixture and inducted into the crank chamber 6, thereby lubricating any required portions inside the internal combustion engine 1.

When the air-fuel mixture inside the cylinder chamber 3 is ignited, thereby causing the piston 4 to begin an expansion stroke, the piston 4 begins to descend, thereby to close the intake port 41. As a result, the air-fuel mixture that has been drawn into the crank chamber 6 is pre-compressed in the crank chamber 6. When the scavenging ports 42 are opened so as to be communicated with the cylinder chamber 3, the inducted air-fuel mixture that has been pre-compressed is allowed to flow, via the scavenging passageways 43, into the cylinder chamber 3 from the scavenging ports 42, thereby starting a repetition of the above-described operating cycle.

Figure 5:
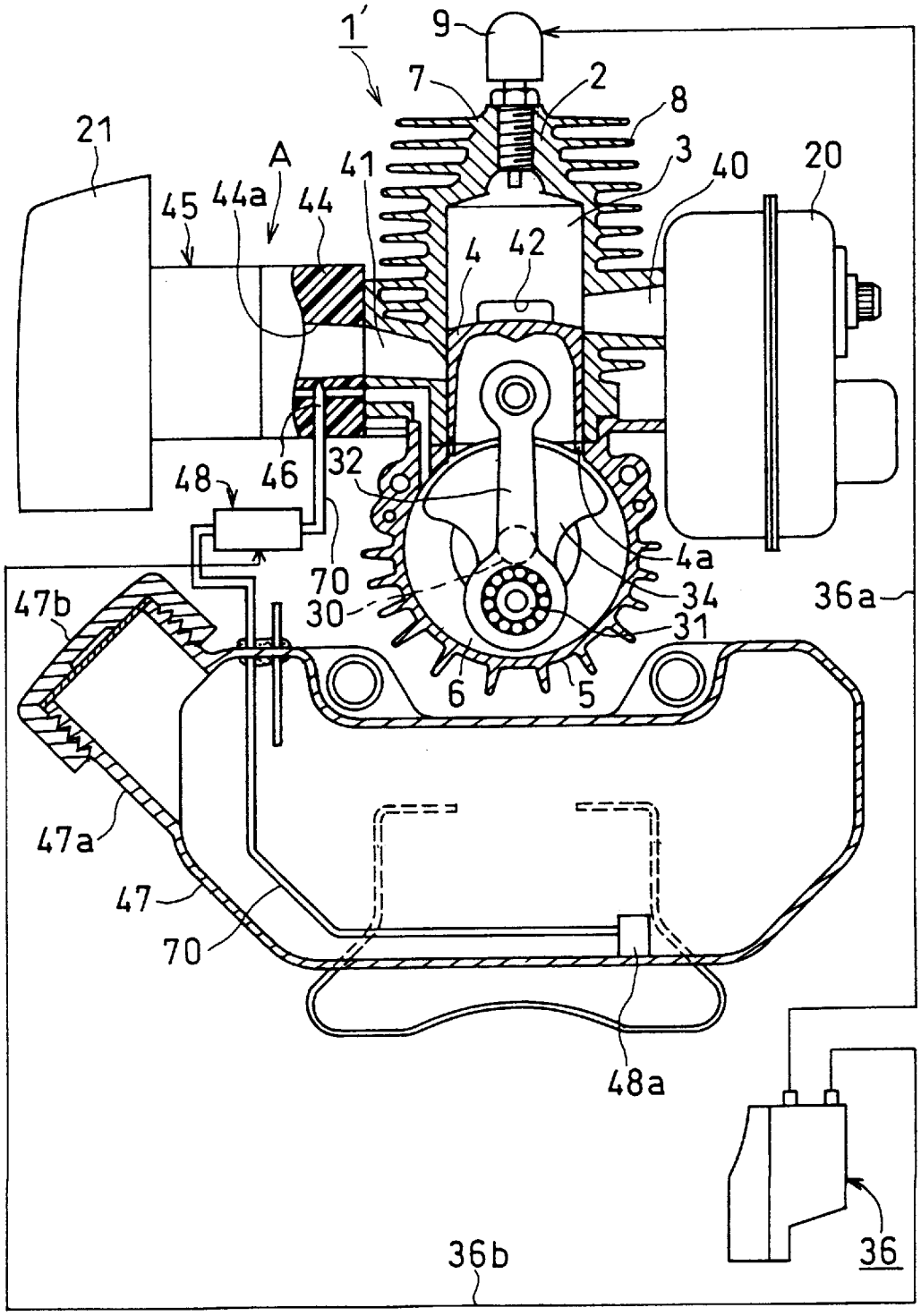
FIG. 5 is a longitudinal cross-sectional view illustrating a two-stroke internal combustion engine that is equipped with a second embodiment of a separate lubricating device according to the present invention.

Next, the second embodiment of the present invention will be explained with reference to FIG. 5. The construction of the separate lubricating device for an internal combustion engine 1' according to the second embodiment is substantially the same as that of the separate lubricating device of the aforementioned first embodiment except that the electric deliverer 48 for lubricating oil is disposed outside the oil tank 47, so that the lubricating oil is drawn into the electric deliverer 48 through the strainer 48*a* from the oil tank 47, and the lubricating oil thus drawn in is delivered through the pipe 70 to the lubricating oil injection nozzle 46, which is directed to face the passage 44*a* of the heat insulator 44. As a result, the lubricating oil is injected into the passage 44*a* from the lubricating oil injection nozzle 46.

In the separate lubricating device for a two-stroke internal combustion engine according to the aforementioned first or second embodiment, since the electric deliverer 48 for lubricating oil to be delivered from the oil tank 47 is disposed separately and away from the lubricating oil injection nozzle 46 for injecting the lubricating oil in an air-fuel mixture, it is possible to prevent the electric deliverer 48 from being influenced by the heat and vibration of the internal combustion engine, thus enabling the electric deliverer 48 to control the delivery of the lubricating oil therefrom to the internal combustion engine with high precision, and to improve the durability thereof.

Further, since the electric deliverer 48 for lubricating oil is disposed away from the lubricating oil injection nozzle 46, and at the same time, since the lubricating oil is fed to an internal combustion engine by positioning the electric deliverer 48 close to the oil tank 47 (including the case where the electric deliverer 48 is positioned inside the oil tank), it is possible to inject the lubricating oil into an air-fuel mixture by making use of only the delivery power of the electric deliverer 48 without necessitating the employment of a self-suction type oil pump that has been conventionally required.

Additionally, since the electric deliverer 48 is positioned inside the oil tank 47, a heating element 63 composed for instance of a solenoid that has been attached to the electric deliverer 48 can be cooled by the lubricating oil accommodated inside the oil tank 47. As a result, the electric deliverer 48 can be allowed to operate under a constant temperature condition, thus making it possible to control the feeding of lubricating oil with high precision.

Further, when the electric deliverer 48 is disposed inside the oil tank 47, the electric deliverer 48 can incorporate the strainer 48*a*. As a result, it is possible to miniaturize the entire body of the electric deliverer 48, and at the same time, to dispense with an intake pipe for the electric deliverer 48, thus facilitating the mounting of the electric deliverer 48 onto the oil tank 47.

While the present invention has been explained based on the foregoing embodiments, it will be understood that the construction of the device can be varied without departing from the spirit and scope of the invention as claimed in the following claims.

For example, the lubricating oil injection control means of the injection nozzle 46 may not be the aforementioned heating element 63, but may be a vibrator, a piezoelectric element, or an electromagnetic element.

Figure 6:
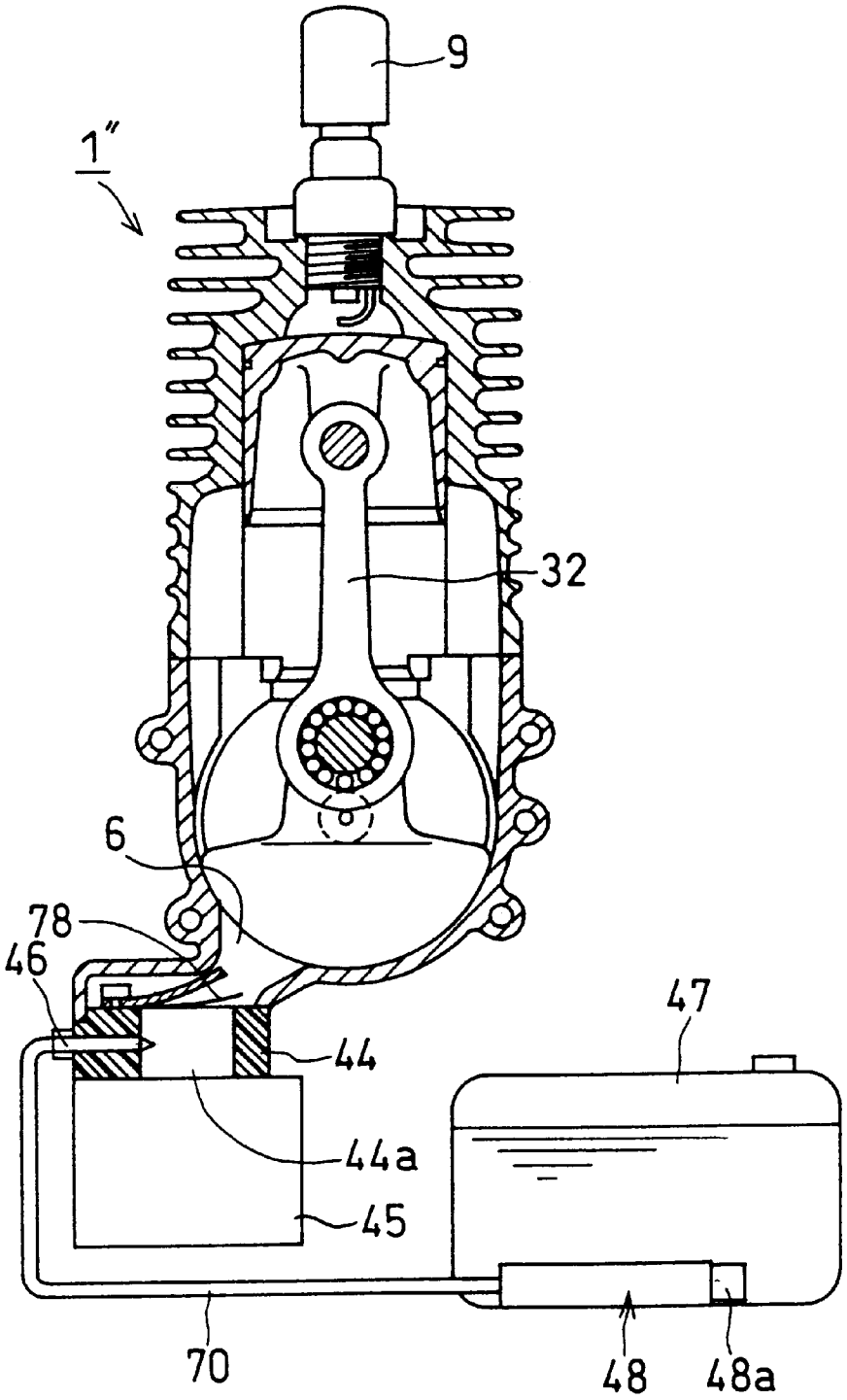
FIG. 6 is a longitudinal cross-sectional view illustrating a two-stroke internal combustion engine that is equipped with a third embodiment of a separate lubricating device according to the present invention.

Further, although the internal combustion engine illustrated in the foregoing embodiment is constructed such that the injection nozzle 46 is disposed at a portion of the air-intake system "A" that is located on the upstream side of the intake port 41 formed in the cylinder block 2, it may be disposed at any suitable position, such as in a portion of the heat insulator 44 which is located, as shown in FIG. 6, on the upstream side of a reed valve 78 in an internal combustion engine 1" of the type where an air-fuel mixture is introduced into the crank chamber 6 through the reed valve 78.

As will be clearly understood from the above explanation, with the separate lubricating device for a two-stroke internal combustion engine of the present invention, since the electric deliverer for lubricating oil is disposed away from the lubricating oil injection nozzle, it is possible to prevent the electric deliverer from being influenced by the heat and vibration of internal combustion engine.

Further, since the electric deliverer for lubricating oil is disposed inside the oil tank so as to deliver the lubricating oil toward the lubricating oil injection nozzle, it is possible to enhance the self-suctioning property of lubricating oil and to improve the efficiency of the delivery of lubricating oil. Furthermore, since the electric deliverer can be always cooled by the lubricating oil, it is possible to stably control the delivery of lubricating oil with high precision and to assure a stable delivery of lubricating oil for a long period of time, thus achieving an excellent durability.

What is claimed is:

1. A separate lubricating device for a two-stroke internal combustion engine provided with an air intake system, the separate lubricating device comprising:

a lubricating oil injection nozzle for injecting a lubricating oil into a passage of the air intake system; and an electric deliverer for delivering a lubricating oil from an oil tank to the lubricating oil injection nozzle, the electric deliverer being housed inside the oil tank and positioned remotely from the lubricating oil injection nozzle.

2. The separate lubricating device according to claim 1 wherein the electric deliverer is provided with a heating element for heating the lubricating oil.

3. The separate lubricating device according to claim 1 wherein the electric deliverer incorporates a strainer.

4. The separate lubricating device according to claim 1, wherein the electric deliverer is provided with a flow sensor for detecting a flow rate of a lubricating oil being delivered From the electric deliverer.

5. A separate lubricating device for a two-stroke internal combustion engine provided with an air intake system, the separate lubricating device comprising:

a lubricating oil injection nozzle for injecting a lubricating oil into a passage of the air intake system; and an electric deliverer for delivering a lubricating oil from an oil tank to the lubricating oil injection nozzle, the electric deliverer being positioned remotely from the lubricating oil injection nozzle, wherein the electric deliverer is provided with a heating element for heating the lubricating oil.

6. A separate lubricating device for a two-stroke internal combustion engine provided with an air intake system, the separate lubricating device comprising:

a lubricating oil injection nozzle for injecting a lubricating oil into a passage of the air intake system; and an electric deliverer for delivering a lubricating oil from an oil tank to the lubricating oil injection nozzle, the electric deliverer being positioned remotely from the lubricating oil injection nozzle, wherein the electric deliverer incorporates a strainer.

7. A separate lubricating device for a two-stroke internal combustion engine provided with an air intake system, the separate lubricating device comprising:

a lubricating oil injection nozzle for injecting a lubricating oil into a passage of the air intake system; and an electric deliverer for delivering a lubricating oil from an oil tank to the lubricating oil injection nozzle, the electric deliverer being positioned remotely from the lubricating oil injection nozzle, wherein the electric deliverer is provided with a flow sensor for detecting a flow rate of a lubricating oil being delivered from the electric deliverer.

* * * * *